US005119757A

United States Patent [19]

Chino et al.

[11] Patent Number: 5,119,757

[45] Date of Patent: Jun. 9, 1992

[54] DEVICE FOR APPLYING LIQUID TO MOVING WEB

[75] Inventors: Naoyoshi Chino; Norio Shibata; Tsunehiko Sato, all of Kanagawa, Japan

[73] Assignee: Fuji Photo Film Co., Ltd., Kanagawa, Japan

[21] Appl. No.: 505,086

[22] Filed: Apr. 5, 1990

[30] Foreign Application Priority Data

Apr. 6, 1989 [JP] Japan ..... 1-85671
Apr. 6, 1989 [JP] Japan ..... 1-85672

[51] Int. Cl.[5] ..... B05C 5/02
[52] U.S. Cl. ..... 118/410; 118/419
[58] Field of Search ..... 118/410, 419, 123

[56] References Cited

U.S. PATENT DOCUMENTS 4,424,762 1/1984 Tanaka et al. ..... 118/410
4,491,082 1/1985 Barch et al. ..... 118/234
4,577,362 3/1986 Tanaka et al. ..... 118/123 X

*Primary Examiner*—Michael G. Wityshyn
*Attorney, Agent, or Firm*—Sughrue, Mion, Zinn, Macpeak & Seas

[57] ABSTRACT

An application device for applying a liquid such as a magnetic coating liquid to the surface of a continuously moving web in which the amount of chipping of the surface portions of the outlet portion of the coating head thereof, and hence the amount of streaking in the applied layer of liquid, are remarkably reduced. The outlet portion of the application head is made of a very hard alloy, preferably tungsten carbide, containing crystal grains of a carbide 5 μm or less in mean diameter conjoined to each other by a metal, preferably cobalt in an amount of 12% or less.

9 Claims, 1 Drawing Sheet

DEVICE FOR APPLYING LIQUID TO MOVING WEB

BACKGROUND OF THE INVENTION

The present invention relates to a device for applying a liquid, such as a photographic photosensitive liquid, a magnetic liquid or a surface protective liquid, to a flexible carrier such as a plastic film, paper or a metal leaf, hereinafter often referred to as web.

Conventional devices for applying a liquid to a web may be, for example, of the extrusion type, the curtain flow type, the blade doctor type, or the slide coat type. In these devices, the liquid is applied at a uniform thickness to the continuously moving web while the applied quantity of the liquid is regulated by the metal edge portion of an extrusion head, a slide coating head, or a blade, along which a narrow slot is defined. For example, an application head 1 of the extrusion type includes a pocket 3, a slot 4, a doctor edge portion 5 and a back edge portion 6, as shown in FIG. 1.

The pocket 3 is a liquid reservoir having a nearly circular cross section and extending with the cross section along the width of the web. The effective length of the pocket 3 along the width of the web is equal to or slightly larger than the width of the liquid-applied area of the web. Both the open ends of the pocket 3 extending through the body of the head 1 are closed by seal plates 7 fitted on both ends of the pocket 3.

The slot 4, which extends through the body of the head 1 from the pocket 3 toward the web, is a relatively narrow passage extending along the width of the web as well as the pocket. The length of the outlet of the slot 4 along the width of the web is nearly equal to the width of the liquid-applied area of the web. The doctor edge portion 5 and the back edge portion 6 are provided at the outlet edges of the slot 4 so that the doctor edge is located downstream to the back edge portion with regard to the direction of the movement of the web, A liquid feed system (not shown in FIG. 1) is connected to a short pipe 9 projecting from the seal plate 7 so that a liquid C is filled into the pocket 3 and the slot 4 and then discharged from the slot with a uniform liquid pressure distribution along the width of the web.

The doctor edge portion 5 and the back edge portion 6 may be made of a very hard alloy, as disclosed in Japanese Unexamined Published Patent Applications Nos. 84771/82 and 104666/83, to increase the degree of rectangularity and flatness of the edge portions so as to enable the liquid to flow in a laminar manner from the pocket 3 with a uniform flow rate distribution and a uniform pressure distribution along the width of the web. Moreover, the wear resistance of the top of the application head 1 of the extrusion type, which is pushed toward the moving web in applying the liquid thereto, is enhanced.

The metallic doctor edge portion 5 is unavoidably eroded by the liquid discharged from the slot 4. This phenomenon is particularly conspicuous if the liquid contains an abrasive substance—for example, 20 parts or more by weight of the substance are added in the form of angular grains of 0.5 μm or less in diameter to 100 parts by weight of a magnetic powder—as a magnetic liquid often does. Such wear is much caused not only in the application head of the extrusion type but also in the metal edge portions of the application devices of the curtain flow type, the blade doctor type, the slide coat type and so forth.

In recent years, the density of recording in a magnetic recording medium and the number of the various layers which form the medium have been increased. Along with such increases, the thickness of the layer of magnetic liquid applied to a nonmagnetic web in manufacturing the magnetic recording medium has had to be reduced. Also, it has been desired to increase the speed of application of the liquid to the web so as to raise the productivity of the process for producing the medium. It has also been desired to improve the magnetic properties of the recording medium by adding additives such as a lubricant and a dispersant to the magnetic dispersion liquid which is applied to a nonmagnetic web.

However, when such a magnetic liquid is applied at a high speed to a web by an application device of the extrusion type and whose application head is made of a very hard alloy, as disclosed in Japanese Unexamined Published Patent Applications Nos. 84771/82 and 104666/83, in such a manner that the thickness of the dried magnetic layer made from the applied liquid on the web is as small as 10 μm or less, streaking tends to occur in the surface of the layer, namely, the liquid is not uniformly applied to the web.

Also, when a magnetic dispersion liquid containing an increased quantity of a lubricant is applied to a web by such a device, streaking tends to occur in the surface of the layer of the applied liquid on the web, namely, the liquid is not uniformly applied to the web. This is also a problem.

Carrying out repeated intensive studies, the present inventors have found that such streaking is due to the state of the surface of the very hard alloy of which the application head is made. Upon examining the surface of the doctor edge portion 5 of an application head made of a very hard alloy, it was found that the doctor edge portion had chipped areas 10 of about fifteen microns to scores of microns in mean diameter, as shown in FIG. 2. Such chips were found in almost all of edges of the application head. It is presumed that the chips result from the fact that the very hard alloy is composed of crystal grains of a carbide such as a tungsten carbide (WC), and a conjoining metal such as cobalt, which conjoins the crystal grains to each other.

When an application head is to be manufactured from a very hard alloy, the alloy is cut to a desired form and then accurately ground on the surfaces of the doctor edge portion and back edge portion of the head by a whetstone made of a material such as diamond. At that time, however, the crystal grains of the carbide, which are conjoined to each other by the metal, are not ground in part of the surface of the alloy, but instead are chipped from the surface so that hollows are left in the surface. Such hollows in the edges of the application head are the chipped portions In general, the greater the diameter of the crystal grains, the larger the size of the chips.

Examining the surface of an application head which causes streaking in the layer of the applied liquid on the web, the present inventors found the surface corroded. Such corrosion was found in almost all of such application heads made of very hard alloys. It is presumed that the corrosion results from the fact that the very hard alloy is composed of crystal grains of a carbide such as a tungsten carbide (WC), and a conjoining metal such as cobalt, which conjoins the crystal grains to each other. When the magnetic liquid is applied to the web by the application head, a higher fatty acid such as stearic acid, which is contained in the lubricant, dispersant or the like of the magnetic liquid, oxidizes the conjoining cobalt of the very hard alloy, which oxidization results in the corrosion. The oxidized surface of the application head gradually erodes so that the finished state of the surface deteriorates and the edges of the head become chipped or worn.

When a liquid is applied to a web by an application head having a doctor edge portion whose edges have such chips, the menisci of the liquid at the top of the application head are disturbed due to the chips or an extraneous substance contained in the liquid and then caught at the chips, causing streaking in the layer of the applied liquid on the web, and thus rendering it impossible to form a good layer of the applied liquid on the web. The adverse effects of the chips on the layer of the applied liquid on the web increase accordingly as the speed of the application is increased or the thickness of the layer is reduced.

SUMMARY OF THE INVENTION

The present invention was made in order to solve the problems described above.

Accordingly, it is an object of the present invention to provide an application device which has metal edge portions of high resistance to wear and by which a liquid can be applied to a web so as to form a layer uniform in thickness and with good surface conditions.

The inventive device for applying a liquid to the surface of a continuously moving web while an application head of the device remains pushed relative to the surface of the web at the outlet of the slot of the head is characterized in that at least the part of the head at the outlet of the slot is made of a very hard alloy in which crystal grains of a carbide 5 μm or less in mean diameter are conjoined to each other. The crystal grains of the carbide, which is a tungsten crystal (WC), are 5 μm or less in mean diameter and are conjoined to each other by a conjoining metal such as cobalt.

After the very hard alloy for manufacturing the application head is cut to a desired form, the alloy is accurately ground on the surfaces of the doctor edge portion and back edge portion of the head by a whetstone made of a material such as diamond. Even if crystal grains conjoined to each other by the metal are chipped from the surfaces of the doctor edge portion and the back edge portion at that time, hollows made as a result of the chipping of the surfaces are small in size because the mean diameter of the grains is small. The mean diameter of the crystal grains is set preferably at 3 μm or less, and more preferably at 1.5 μm or less. The conjoining metal is not limited to cobalt, but may be a metal such as titanium, tantalum, niobium or an alloy of such metals. The application head is not limited to a head of the extrusion type, but may be an application member such as a coating geeser and a blade and having a metal edge portion extending along a narrow slot, which produces the same effect as an application head of the extrusion type.

It is another object of the present invention to provide an application device which has metal edge portions having a high resistance to wear and by which a magnetic liquid can be applied to a web so as to form a layer thereon which is uniform in thickness and has good surface conditions. The magnetic liquid, which is a magnetic dispersion liquid whose acid content is 1.5 parts or more by weight to 100 parts by weight of magnetic substance, is applied to the surface of the continuously moving web by the application device while the application head thereof remains pushed relative to the surface of the web at the outlet of the slot of the head. The device is characterized in that the application head is made of a very hard alloy whose cobalt content is 15% or less. The alloy is composed of crystal grains of a carbide such as tungsten carbide (WC) and cobalt, which conjoins the crystal grains to each other. Since the content of the cobalt likely to be oxidized by the acid constituent of the magnetic liquid is less than that of the cobalt of a conventional application head, the surface of the former head is less likely to corrode due t the acid constituent than that of the latter head, although the acid constituent content of the magnetic liquid is 1.5 parts or more by weight to 100 parts by weight of the magnetic substance. The doctor edge portion and back edge portion of the application head provided in accordance with the present invention are thus made less likely to be worn or chipped. The acid constituent of the magnetic liquid is usually a higher fatty acid such as stearic acid, myristic acid, aldiminic acid, oleic acid, linoleic acid, or linolenic acid. The cobalt content of the very hard alloy is set preferably at 12% or less.

DESCRIPTION OF THE PREFERRED EMBODIMENTS

Figure 1:
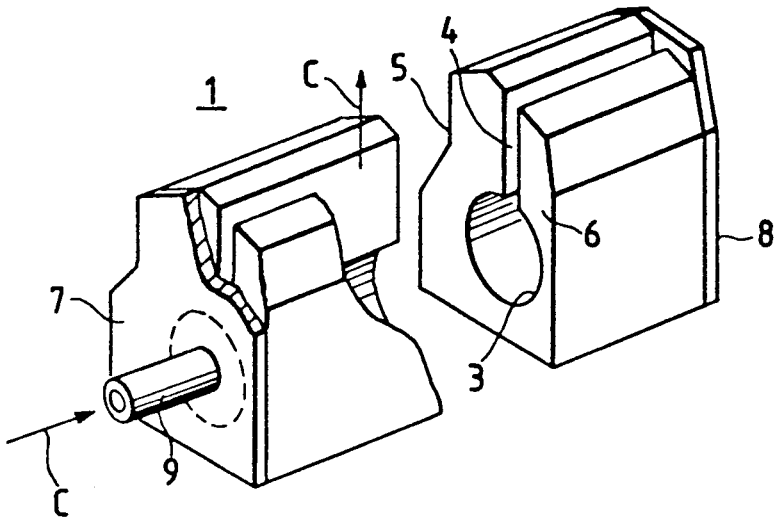
FIG. 1 is a perspective cut-away view of an application head of the extrusion type.
Figure 2:
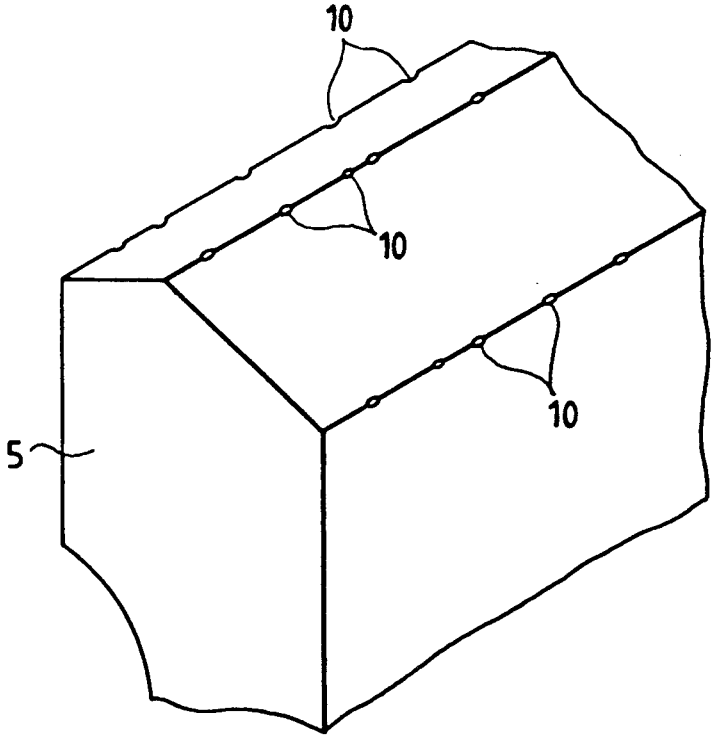
FIG. 2 is an enlarged perspective view of the doctor edge portion of an application head of the extrusion type.

Preferred embodiments of the present invention are hereafter described in detail to clarify the features of the invention.

Actual examples of Embodiment 1

Substances whose quantities are shown in Table 1 below were put in a ball mill and subjected to mixing and dispersion therein for 10.5 hours so that a magnetic liquid 1 to be applied was prepared. When the viscosity of the magnetic liquid 1 was measured by a viscosity meter of the ring-cone type, the reading thereof was 2.0 poise at a shearing velocity of $10^2$ $sec^{-1}$.

TABLE 1

| | |
|---|---|
| Co-γ-$Fe_2O_3$ (Hc = 750 Oe) | 100 parts by weight |
| Copolymer of vinyl chloride, vinyl acetate and maleic anhydride (86:13:1 in copolymerization ratio and 400 in polymerization degree) | 15 parts by weight |
| Polyurethane (50,000 in molecular weight) | 10 parts by weight |
| Stearic acid | 2 parts by weight |
| Dimethyl polysiloxane | 0.2 part by weight |
| Carbon (0.02 μm in grain diameter) | 10 parts by weight |
| Alumina | 20 parts by weight |
| Polyisocyanate | 6 parts by weight |
| Butyl acetate | 200 parts by weight |
| Methylethylketone | 50 parts by weight |
| Cyclohexanone | 10 parts by weight |

Application heads Nos. 1, 2, 3 and 4, the configuration of each of which was the same as that disclosed in Japanese Unexamined Published Patent Application No. 104666/83,were manufactured from four kinds of very hard alloys composed of cobalt and crystal grains of a tungsten carbide and of 1.5 μm, 3 μm, 5 μm and 6 μm in mean diameter, respectively. The size and number of chips of the downstream part of the doctor edge portion of each of the application heads were measured. Table 2 shows the results of the measurement.

The magnetic liquid 1 was applied to the polyethylene terephthalate web of 15 μm in thickness and 500 mm in width by application devices including the application heads Nos. 1, 2, 3 and 4. The tension of the web at the application head was 8 kg per 500 mm in width, the width of the liquid-applied area of the web was 450 mm, the speed of the application was set at 100 m/min, 200 m/min, and 300 m/min sequentially, and the thickness of the dried layer formed from the applied liquid on the web was set at 1 μm, 2 μm, 3 μm and 4 μm sequentially. Magnetic recording media were thus manufactured. The number of streaks occurring in the surface of each of the layers formed from the applied liquids on the webs of the media was measured along the width of the web. The results of these measurement are shown in Table 2.

TABLE 2

| Application Head No. | Mean Diameter of Grains (μm) | Chips of Edge Portion | Speed of Application (m/min) | Thickness of Layer (μm) | Number of Streaks |
|---|---|---|---|---|---|
| Application Head No. 1 | 6 | Large number of chips 20 μm or less in mean diameter were formed. | 100 | 1 | 10 |
| | | | | 2 | 8 |
| | | | | 3 | 8 |
| | | | | 4 | 7 |
| | | | 200 | 1 | 12 |
| | | | | 2 | 11 |
| | | | | 3 | 10 |
| | | | | 4 | 8 |
| | | | 300 | 1 | 15 |
| | | | | 2 | 12 |
| | | | | 3 | 10 |
| | | | | 4 | 8 |
| Application Head No. 2 | 5 | Small number chips 10 μm or less in mean diameter were formed. | 100 | 1 | 5 |
| | | | | 2 | 4 |
| | | | | 3 | 2 |
| | | | | 4 | 2 |
| | | | 200 | 1 | 4 |
| | | | | 2 | 4 |
| | | | | 3 | 2 |
| | | | | 4 | 1 |
| | | | 300 | 1 | 5 |
| | | | | 2 | 4 |
| | | | | 3 | 2 |
| | | | | 4 | 1 |
| Application Head No. 3 | 3 | Small number of chips 7 μm or less in mean diameter were formed. | 100 | 1 | 4 |
| | | | | 2 | 3 |
| | | | | 3 | 2 |
| | | | | 4 | 2 |
| | | | 200 | 1 | 4 |
| | | | | 2 | 4 |
| | | | | 3 | 2 |
| | | | | 4 | 2 |
| | | | 300 | 1 | 5 |
| | | | | 2 | 4 |
| | | | | 3 | 3 |
| | | | | 4 | 2 |
| Application Head No. 4 | 1.5 | Small number of chips 3 μm or less in mean diameter were formed. | 100 | 1 | 2 |
| | | | | 2 | 2 |
| | | | | 3 | 1 |
| | | | | 4 | 1 |
| | | | 200 | 1 | 2 |
| | | | | 2 | 2 |
| | | | | 3 | 2 |
| | | | | 4 | 1 |
| | | | 300 | 1 | 3 |
| | | | | 2 | 2 |
| | | | | 3 | 2 |
| | | | | 4 | 1 |

Actual Examples of Embodiment 2

Substances in quantities as shown in Table 3 were put in a ball mill and subjected to mixing and dispersion therein for 10.5 hours to prepare a magnetic liquid 2. When the viscosity of the magnetic liquid 2 was measured with viscosity meter of the ring-cone type, the reading was 2.0 poise at a shearing velocity of $10^2$ $sec^{-1}$.

TABLE 3

| | |
|---|---|
| Co-γ-$Fe_2O_3$ (Hc = 600 Oe) | 100 parts by weight |
| Copolymer of vinyl chloride, vinyl acetate and maleic anhydride (86:13:1 in copolymerization ratio and 400 in polymerization degree) | 15 parts by weight |
| Polyurethane (50,000 in molecular weight) | 10 parts by weight |
| Stearic acid | 2 parts by weight |
| Dimethyl polysiloxane | 0.2 part by weight |
| Carbon (0.02 μm in grain diameter) | 10 parts by weight |
| Alumina | 20 parts by weight |
| Polyisocyanate | 6 parts by weight |
| Butyl acetate | 200 parts by weight |
| Methylethylketone | 50 parts by weight |

Application heads Nos. 5, 6, 7 and 8, each of which was of the extrusion type and had two doctor edge portions and a configuration as disclosed in Japanese Published Unexamined Patent Application No. 88080/88, were manufactured from four kinds of very hard alloys composed of cobalt and crystal grains of tungsten carbide (WC) having respective mean diameters of 1.5 μm, 3 μm, 5 μm and 6 μm. The size and number of chips of the downstream part of the downstream doctor edge portion of each of the application heads were measured. FIG. 4 shows the results of these measurements.

The magnetic liquids 1 and 2 were applied to a polyethylene terephthalate web of 15 μm in thickness and 500 mm in width with application devices including the application heads Nos. 5, 6, 7 and 8, whereby the liquid 2 formed a lower layer on the web and the other liquid 1 an upper layer on the lower layer. During the coating process, the tension of the web at the application head was 8 kg per 500 mm width, the width of the liquid-applied area of the web was 450 mm, the speed of application was set at 100 m/min, 200 m/min and 300 m/min sequentially, and the thickness of the dried upper layer was set at 0.5 μm, 1 μm and 2 μm sequentially. Magnetic recording media were thus manufactured.

The number of streaks in the surface of the layer of each of the media was measured along the width of the web. The results of these measurement are shown in FIG. 4.

The thickness of the dried lower layer of each of the media was fixed at 4 μm. The radii of curvature $R_1$ and $R_2$ of the doctor edge portions of each of the application heads, and angles $\theta_1$, $\theta_2$ and $\theta_3$ indicative of the geometry of the doctor edge portions were 6 mm, 8 mm, 15 degrees, 8 degrees and 2 degrees, respectively.

TABLE 4

| Application Head No. | Mean Diameter of Grains (μm) | Chips of Edge Portion | Speed of Application (m/min) | Thickness of Layer (μm) | Number of Streaks |
|---|---|---|---|---|---|
| Application Head No. 5 | 6 | Large number of chips 20 μm or less in mean diameter were formed. | 100 | 0.5 | 20 |
| | | | | 1 | 15 |
| | | | | 2 | 10 |
| | | | 200 | 0.5 | 23 |
| | | | | 1 | 17 |
| | | | | 2 | 11 |
| | | | 300 | 0.5 | 25 |
| | | | | 1 | 23 |
| | | | | 2 | 20 |
| Application Head No. 6 | 5 | Large number of chips 10 μm or less in mean diameter were formed. | 100 | 0.5 | 6 |
| | | | | 1 | 5 |
| | | | | 2 | 3 |
| | | | 200 | 0.5 | 6 |
| | | | | 1 | 4 |
| | | | | 2 | 4 |
| | | | 300 | 0.5 | 7 |
| | | | | 1 | 5 |
| | | | | 2 | 5 |
| Application Head No. 7 | 3 | Large number of chips 6 μm or less in mean diameter were formed. | 100 | 0.5 | 5 |
| | | | | 1 | 4 |
| | | | | 2 | 3 |
| | | | 200 | 0.5 | 5 |
| | | | | 1 | 4 |
| | | | | 2 | 4 |
| | | | 300 | 0.5 | 6 |
| | | | | 1 | 5 |
| | | | | 2 | 5 |
| Application Head No. 8 | 1.5 | Large number of chips 3 μm or less in mean diameter were formed. | 100 | 0.5 | 3 |
| | | | | 1 | 2 |
| | | | | 2 | 1 |
| | | | 200 | 0.5 | 3 |
| | | | | 1 | 2 |
| | | | | 2 | 1 |
| | | | 300 | 0.5 | 4 |
| | | | | 1 | 3 |
| | | | | 2 | 2 |

It is understood from Tables 2 and 4 that the size and number of chips on the doctor edge portions and the number of the streaks formed in the surfaces of the layers became smaller as the mean diameter was reduced of the crystal grains of the tungsten carbide contained in each of the very hard alloys constituting the application heads Nos. 1, 2, 3, 4, 5, 6, 7 and 8. This tendency became more conspicuous as the speed of application was increased or the thickness of the layer or layers on the web was decreased. Therefore, it was demonstrated that the thickness of the layer of the applied liquid on the web became more uniform and the state of the surface thereof was improved as the mean diameter of the crystal grains of the tungsten carbide contained in the very hard alloy was reduced.

Actual Examples of Embodiment 3

Substances in quantities as shown in Table 5 were subjected to mixing and dispersion. The quantity of stearic acid was set as shown in Table 6. Five magnetic substance dispersion liquids A1, A2, A3, A4 and A5 to be applied were prepared.

TABLE 5

| | |
|---|---|
| Co-γ-$Fe_2O_3$ (Hc = 600 Oe) | 100 parts by weight |
| Copolymer of vinyl chloride, vinyl acetate and alcohol | 15 parts by weight |
| Polyurethane (50,000 in molecular weight) | 10 parts by weight |
| Stearic acid | A parts by weight |
| Dimethyl polysiloxane | 0.2 part by weight |
| Carbon (0.01 μm in grain diameter) | 10 parts by weight |
| Alumina | 20 parts by weight |

TABLE 5-continued

| | |
|---|---|
| Polyisocyanate | 6 parts by weight |
| Butyl acetate | 200 parts by weight |
| Methylethylketone | 50 parts by weight |

TABLE 6

| Liquid | A1 | A2 | A3 | A4 | A5 |
|---|---|---|---|---|---|
| Quantity A (parts by weight) of stearic acid | 0.5 | 1.0 | 1.5 | 2.0 | 3.0 |

Five very hard alloys C1, C2, C3, C4 and C5, which were composed of cobalt of content shown in Table 7 and crystal grains of a tungsten carbide (WC), were manufactured. The surface roughness (Ha) of each of the very hard alloys was measured. The alloys were thereafter immersed in the liquids A1, A2, A3, A4 and A5 at a temperature of 30° C. for two weeks. Afterwards, the surface roughness (Ha) of each of the alloys was measured again, and it was observed whether the surfaces of the alloys had corroded or not. The results of the measurement and the observation are shown in Table 8. The surface roughness (Ha) was the mean roughness of the surface of the alloy along the center line thereof.

TABLE 7

| Alloy | C1 | C2 | C3 | C4 | C5 |
|---|---|---|---|---|---|
| Cobalt content (% by weight) | 20 | 16 | 14 | 11 | 8 |
| Hardness | 83 | 85 | 87 | 88 | 89 |

TABLE 8

| Liquid | Very Hard Alloy | Corrosion | Surface Roughness (Ha) Before Immersion | After Immersion |
|---|---|---|---|---|
| A1 | C1 | ○ | 0.08 | 0.08 |
| | C2 | ○ | 0.08 | 0.08 |
| | C3 | ○ | 0.05 | 0.05 |
| | C4 | ○ | 0.05 | 0.05 |
| | C5 | ○ | 0.05 | 0.05 |
| A2 | C1 | ○ | 0.08 | 0.08 |
| | C2 | ○ | 0.08 | 0.08 |
| | C3 | ○ | 0.07 | 0.07 |
| | C4 | ○ | 0.05 | 0.05 |
| | C5 | ○ | 0.05 | 0.05 |
| A3 | C1 | Δ | 0.08 | 0.10 |
| | C2 | ○ | 0.08 | 0.08 |
| | C3 | ○ | 0.07 | 0.07 |
| | C4 | ○ | 0.05 | 0.05 |
| | C5 | ○ | 0.05 | 0.05 |
| A4 | C1 | Δ | 0.08 | 0.10 |
| | C2 | ○ | 0.08 | 0.08 |
| | C3 | ○ | 0.07 | 0.07 |
| | C4 | ○ | 0.05 | 0.05 |
| | C5 | ○ | 0.05 | 0.05 |
| A5 | C1 | X | 0.08 | 0.15 |
| | C2 | Δ | 0.08 | 0.10 |
| | C3 | ○ | 0.07 | 0.07 |
| | C4 | ○ | 0.05 | 0.05 |
| | C5 | ○ | 0.05 | 0.05 |

○ : The alloy did not corrode.
Δ: The alloy slightly corroded but did not affect the application.
X: The alloy considerably corroded.

It is understood from Table 8 that the surface of the very hard alloys C1 and C2, which had a cobalt content of 16% or more by weight and were immersed in the liquids A3, A4 and A5 in which 1.5 parts or more by weight of stearic acid which was the acid constituent of the liquid, and which contained up to 100 parts by weight of the magnetic substance Co—γ—$Fe_2O_3$, corroded considerably and deteriorated in surface roughness, This phenomenon became more conspicuous as the quantity of the stearic acid increased.

Actual Examples of Embodiment 4

Application heads Nos. 9, 10, 11, 12 and 13, each of which was of the extrusion type and had two doctor edge portions and the same configuration as disclosed in Japanese Unexamined Published Patent Application No. 88080/88, were manufactured from very hard alloys which were the same as the above-mentioned very hard alloys C1, C2, C3, C4 and C5. Each of the magnetic substance dispersion liquids A2, A3 and A5 mentioned in thickness and 520 mm in width by each of application devices including the application heads Nos. 9, 10, 11, 12 and 13, so that upper and lower layers were simultaneously formed of the same liquid applied on the web. During the application, the tension of the web at the application head was 10 kg per 520 mm in width, the width of the liquid-applied area of the web was 500 mm, the speed of the application was 200 m/min, and the thickness of each of the upper and the lower dried layers formed from the applied liquid was 2 μm. The application of each of the liquids A2, A3 and A5 was continued for 50 hours. Magnetic recording media were thus manufactured. It was thereafter observed whether or not streaking occurred in the surface of the layer of each of the media and whether many chips were formed in the top of each of the application heads. The results of the observation are shown in Table 9. The radii of curvature $R_1$ and $R_2$ of the doctor edge portions of each of the application heads Nos. 9, 10, 11, 12 and 13 and angles $\theta_1$, $\theta_2$ and $\theta_3$ indicative of the geometry of the doctor edge portions were 6 mm, 8 mm, 15 degrees, 8 degrees and 2 degrees, respectively.

TABLE 9

| Applied Liquid No. | Application Head No. (Alloy No.) | Streaks | Chips |
|---|---|---|---|
| A2 | 9 (C1) | ○ | ○ |
| | 10 (C2) | ○ | ○ |
| | 11 (C3) | ○ | ○ |
| | 12 (C4) | ○ | ○ |
| | 13 (C5) | ○ | ○ |
| A3 | 9 (C1) | ΔΔ | Δ |
| | 10 (C2) | ○ | ○ |
| | 11 (C3) | ○ | ○ |
| | 12 (C4) | ○ | ○ |
| | 13 (C5) | ○ | ○ |
| A5 | 9 (C1) | X | X |
| | 10 (C2) | Δ | Δ |
| | 11 (C3) | ○ | ○ |
| | 12 (C4) | ○ | ○ |
| | 13 (C5) | ○ | ○ |

Streaks (counted along width of web):
○ : Two streaks or less were formed.
ΔΔ: Three or four streaks were formed.
Δ: Five to seven streaks were formed.
X: Eight to ten streaks were formed.
Chips:
○ : A small number of chips of 3 μm or less in mean diameter were formed.
Δ: A small number of chips of 5 μm or less in mean diameter were formed.
X: A large number of chips of 10 μm or more in mean diameter were formed.

As shown in Table 9, chips were formed in the tops of the doctor edge portions of the application heads Nos. 9 and 10 made of the alloys C1 and C2, each of which had a cobalt content of 16% or more by weight and was used to apply each of the magnetic substance dispersion liquids A3 and A5 in which the quantity of stearic acid, which formed the acid constituent of the liquid, was 1.5 parts or more by weight to 100 parts by weight of the magnetic substance Co—γ—$Fe_2O_3$. In these cases, a large number of streaks were formed in the surface of the layer of the liquid applied to the web by the head. This phenomenon became more conspicuous as the quantity of stearic acid increased. Therefore, it was observed that the number of the streaks formed in the layer of the applied liquid containing stearic acid in a quantity of 1.5 parts or more by weight to 100 parts by weight of the magnetic substance and applied of using an application head made of the very hard alloy decreased as the quantity of cobalt contained in the alloy was reduced, thus making the applied layer more uniform in thickness thereof and obtaining a better state of the surface thereof.

As described above, an application device provided in accordance with the present invention includes an application head, at least the part of which at the outlet of the slot of the head is made of a very hard alloy in which crystal grains of a carbide and of 5 μm or less in mean diameter are conjoined to each other. Even if some of the crystal grains conjoined to each other by a conjoining metal are chipped off the surfaces of the doctor edge portion and back edge portion of the application head when the very hard alloy cut to a desired form for the head is accurately ground on the surfaces of the edge portions thereof, hollows formed as a result of the chipping are small in size. In other words, the chips on the edge portions of the application head at the outlet of the slot thereof are small in size and number.

As further described above, in an application head of an application device provided in accordance with the present invention, a magnetic liquid which is a magnetic substance dispersion liquid whose acid constituent content is 1.5 parts or more by weight to 100 parts by weight of the magnetic substance of the liquid is applied to the surface of a continuously moving web by the head while the part of the head at the outlet of the slot thereof remains pushed relative to the surface of the web, which part is made of a very hard alloy whose cobalt content is 15% or less. Although the acid constituent content of the magnetic liquid is 1.5 parts or more by weight to 100 parts by weight of the magnetic substance of the liquid due to the fact that larger quantities of additives such as a lubricant and a dispersant are added to the liquid in order to improve the magnetic properties of a magnetic recording media manufactured by applying the liquid to the web so that mutually stacked layers are formed of the liquid on the web, the surface of the application head is less likely to corrode due to the acid constituent of the liquid than that of a conventional application head made of a very hard alloy because a smaller amount of cobalt, which is likely to be oxidized by the acid constituent, is contained in the very hard alloy for the inventive application head than in that for the latter conventional application head. For that reason, the doctor edge portion and back edge portion of the former head are less likely to be worn or chipped. As a result, even if the speed of the application is high and the thickness of the layer of the applied liquid on the web is small, it is less likely that the menisci of the liquid at the top of the application head will be disturbed by the chips of the doctor edge portion and back edge portion of the head or an extraneous substance in the liquid will be caught at the chips of the edge portions. Streaking is thus rendered less likely to occur in the layer of the applied on the web. Therefore, the inventive application device not only has a high wear resistance of the application head, but also functions to form a layer of applied liquid which is uniform in thickness and has a good state of the surface thereof to render the magnetic recording properties of the manufactured magnetic recording medium quite good.

What is claimed is:

1. An application device for applying a liquid to the surface of a continuously moving flexible carrier: comprising an application head having an outlet portion in which is formed a slot, said outlet portion being disposed adjacent said continuously moving flexible carrier, said outlet portion being made of a very hard alloy containing crystal grains of a carbide 5 μm or less in mean diameter and a metal conjoining said crystal grains; and means for supplying a coating liquid through said slot for coating onto said continuously moving flexible carrier.

2. The application device of claim 1, wherein said metal is selected from the group consisting of cobalt, titanium, tantalum, niobium and alloys of cobalt, titanium, tantalum and niobium.

3. The application device of claim 1, wherein said metal is cobalt in an amount of 15% or less.

4. The application device of claim 1, wherein said metal is cobalt in an amount of 12% or less.

5. The application device of claim 1, wherein said very hard alloy is tungsten carbide.

6. The application device of claim 1, wherein said coating liquid is a magnetic substance dispersion liquid having an acid constituent content of 1.5 parts or more by weight to 100 parts by weight of a magnetic substance of said liquid.

7. The application device of claim 6, wherein said magnetic substance is $Co—\gamma—Fe_2O_3$.

8. The application device of claim 6, wherein said acid constituent is a higher fatty acid selected from the group consisting of stearic acid, myristic acid, aldiminic acid, oleic acid, linoleic acid and linolenic acid.

9. The application device of claim 1, wherein said outlet portion comprises at least a doctor edge portion and a back edge portion.

* * * * *